US010957145B2

(12) United States Patent
Navarro Bonilla et al.

(10) Patent No.: US 10,957,145 B2
(45) Date of Patent: Mar. 23, 2021

(54) WRAPPING AND DISPENSING APPARATUS

(71) Applicants: Marisol Navarro Bonilla, La Habra, CA (US); Younes EL Majdoub, La Habra, CA (US)

(72) Inventors: Marisol Navarro Bonilla, La Habra, CA (US); Younes EL Majdoub, La Habra, CA (US)

( * ) Notice: Subject to any disclaimer, the term of this patent is extended or adjusted under 35 U.S.C. 154(b) by 0 days.

(21) Appl. No.: 16/425,941

(22) Filed: May 29, 2019

(65) Prior Publication Data

US 2019/0355202 A1 Nov. 21, 2019

Related U.S. Application Data

(63) Continuation-in-part of application No. 15/874,828, filed on Jan. 18, 2018, now abandoned.

(60) Provisional application No. 62/450,063, filed on Jan. 24, 2017.

(51) Int. Cl.

| | |
|---|---|
| ***G07F 11/72*** | (2006.01) |
| ***B65H 16/00*** | (2006.01) |
| ***B65H 5/28*** | (2006.01) |

(52) U.S. Cl.

CPC ..... *G07F 11/72* (2013.01); *B65H 5/28* (2013.01); *B65H 16/005* (2013.01); *B65H 2701/174* (2013.01)

(58) Field of Classification Search

CPC .. A41D 13/081; A63B 2244/102; B65H 5/28; B65H 16/005; B65H 2701/174; G07F 11/72

See application file for complete search history.

(56) References Cited

U.S. PATENT DOCUMENTS

| | | | | |
|---|---|---|---|---|
| 3,312,321 | A | 4/1967 | Gretzsky | |
| 4,266,740 | A | 5/1981 | Ramos | |
| 5,533,689 | A | 7/1996 | Chalfant | |
| 6,168,109 | B1 | 1/2001 | Laudenslager | |
| 7,100,902 | B1 | 9/2006 | Lu | |
| 7,374,124 | B2 | 5/2008 | Engelsher | |
| 7,591,397 | B2 | 9/2009 | Leonetti | |
| 7,885,724 | B2 | 2/2011 | Ochi | |
| 2002/0088893 | A1 | 7/2002 | Nichols | |
| 2007/0145179 | A1* | 6/2007 | Engelsher | A61F 15/007 242/532.6 |
| 2009/0030548 | A1* | 1/2009 | Ochi | G07F 9/02 700/232 |
| 2012/0211582 | A1 | 8/2012 | Cid | |
| 2013/0206895 | A1 | 8/2013 | Van Benthem | |
| 2014/0177982 | A1 | 6/2014 | Al Haj Eid | |
| 2014/0332551 | A1 | 11/2014 | Zorick | |

(Continued)

*Primary Examiner* — Timothy R Waggoner

(74) *Attorney, Agent, or Firm* — Cionca IP Law P.C.; Marin Cionca

(57) ABSTRACT

An apparatus may include a housing, a power-supply, a user-interface, a wrap-roller, a dispenser. In one embodiment, the apparatus is configured to roll an unwound hand-wrap after a workout. In another embodiment, a vending machine includes the housing, the power-supply, the user-interface, the wrap-roller, and the dispenser. In this embodiment, the housing includes a plurality of items that may aid in a users' workout and may selectively dispensed from the vending machine. The vending and use of the apparatus may be monetized for profit at sports-related establishments.

14 Claims, 6 Drawing Sheets

(56) References Cited

U.S. PATENT DOCUMENTS

2016/0058633 A1* 3/2016 Broten ..... A61F 15/007
242/546

* cited by examiner

WRAPPING AND DISPENSING APPARATUS

CROSS REFERENCE TO RELATED APPLICATION

The present application is a continuation-in-part application of U.S. patent application Ser. No. 15/874,828, filed Jan. 18, 2018, which claims the benefit of U.S. Provisional Patent Application No. 62/450,063 filed Jan. 24, 2017; both of these applications are incorporated by reference herein in their entirety for all purposes.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of vending machines and more specifically relates to a vending machine including a wrap-roller for winding hand-wraps after use.

2. Description of Related Art

Hand wraps help protect the bones and tendons in a boxer's hands. In addition, they will help support a boxer's wrist and thumb. To help prevent injuries, it is recommended to always wrap one's hands before working out. Variations can produce more wrist support, thumb support, padding for the knuckles or less fabric within the first.

People who box, participate in MMA fighting, and other contact sports often use wraps on their hands and wrists. Some people may forget these wraps at home and be left without an option at the gym. After a workout, it may be extremely tiring and difficult to rewrap used wraps. It may take a considerable amount of time to rewrap the used wraps. A suitable solution is desired.

U.S. Pub. No. 2012/0211582 to Edward Cid relates to a material winder. The described material winder includes a compact and portable device for quickly and conveniently rolling up long strips of material into tight rolls for easy storage and use. The material winder may include a handle having a material guide attached thereto. A winder core may receive material through the material guide. The winder core may be rotated to wind material about the winder core while the material guide ensures the material winds in an even roll.

BRIEF SUMMARY OF THE INVENTION

In view of the foregoing disadvantages inherent in the known vending machines art, the present disclosure provides a novel wrapping and dispensing apparatus. The general purpose of the present disclosure, which will be described subsequently in greater detail, is to provide an apparatus for winding hand-wraps after a workout, and for dispensing items useful for the workout.

An apparatus is disclosed herein. The apparatus includes a housing and a power-supply fixed to the housing and configured to provide power to the apparatus. A user-interface may be fixed to the housing, electrically coupled to the power supply, and configured to receive a non-adhesive wrap in an unwound state as manually fed in by a first end by a user. Further, a wrap-roller may be disposed within the housing and electrically coupled to the power supply, the wrap-roller configured to receive the non-adhesive wrap in the unwound state by the first end from the user interface, and further configured to wind the non-adhesive wrap about the first end until the non-adhesive wrap may be placed in a wound state. In addition to this, a dispenser may be fixed to the housing and configured to dispense the non-adhesive wrap in the wound state from the housing.

A method of using (and monetizing use of) the apparatus is also disclosed herein. The method of using apparatus may comprise the steps of: providing the vending machine as above; selecting at least one item from the inner chamber via the user-interface; and retrieving the selected at least one item from the dispenser.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a wrapping and dispensing apparatus, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to vending machines and more particularly to a wrapping and dispensing apparatus as used to provide a vending machine with a wrap-roller for winding hand-wraps after use that is monetizable.

Generally disclosed is a vending machine capable of automatically rolling hand wraps up after a workout. This may allow tired athletes to have their boxing wraps rolled for them, eliminating the tiring task of doing it themselves. The vending machine may require a user to pay in order to use the vending machine for this purpose. Further, the vending machine may include an option to purchase entirely new wraps for a workout, allowing those who forgot their wraps to obtain a new pair. In addition to this, other accessories may be provided in the vending machine for purchase by the user. Examples of accessories may include mouth guards, boxing gloves, towels, and the like. The monetized use of the machine may be to provide the device in establishments such as boxing clubs (and the like) wherein such accessories may be vended for profit and also services provided in the same location.

Referring now more specifically to the drawings by numerals of reference, there is shown in FIGS. 1-5, various views of an apparatus 100.

Figure 1:
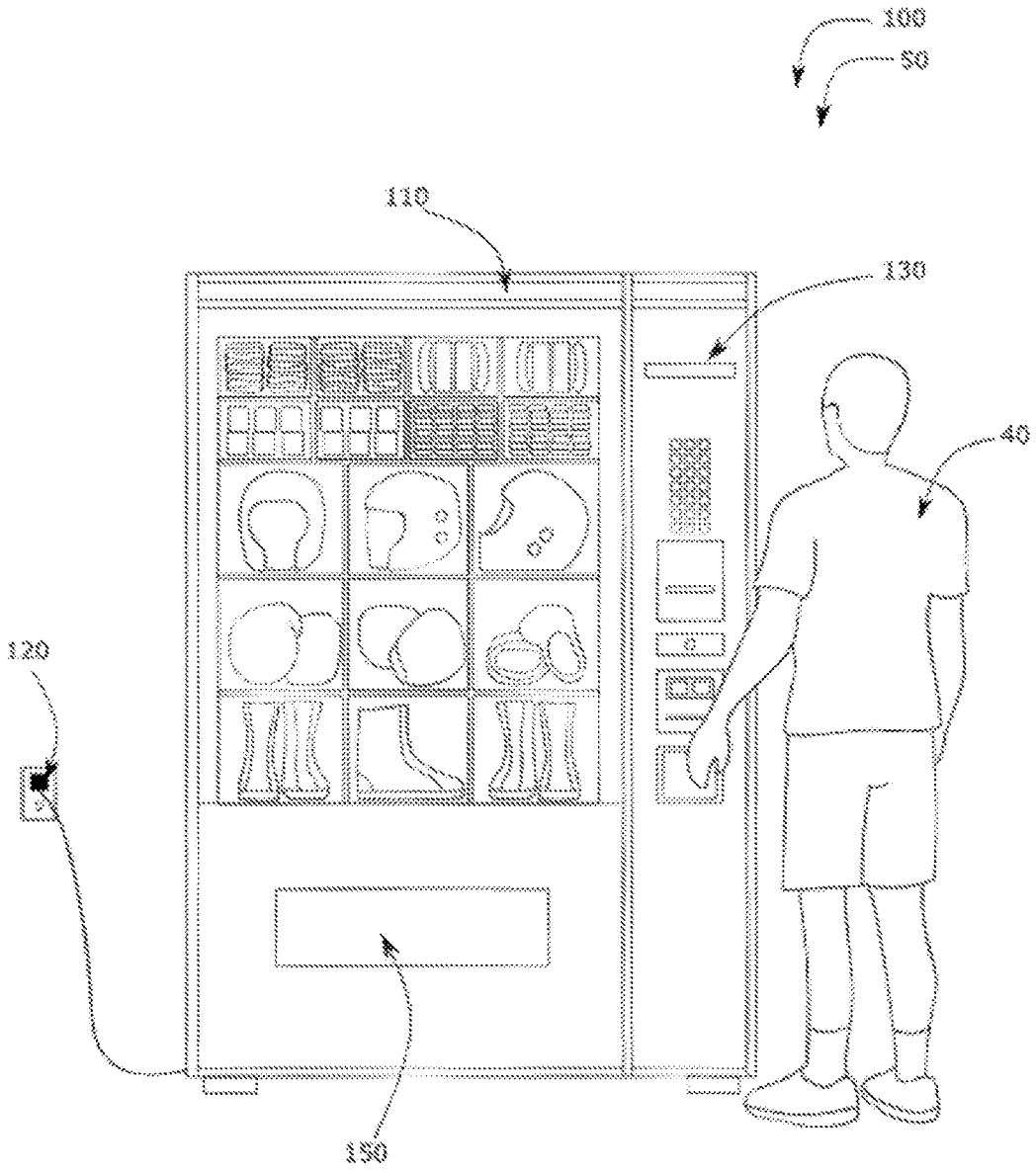
FIG. 1 is a front perspective view of the apparatus during an 'in-use' condition, according to an embodiment of the disclosure.

FIG. 1 shows an apparatus 100 during an 'in-use' condition 150, according to an embodiment of the present disclosure. As illustrated, the apparatus 100 may include a housing 110, a power-supply 120, a user-interface 130, a wrap-roller 140 (FIG. 2), a dispenser 150. As shown, the power-supply 120 may fixed to the housing 110 and configured to provide power to the apparatus 100.

Figure 2:
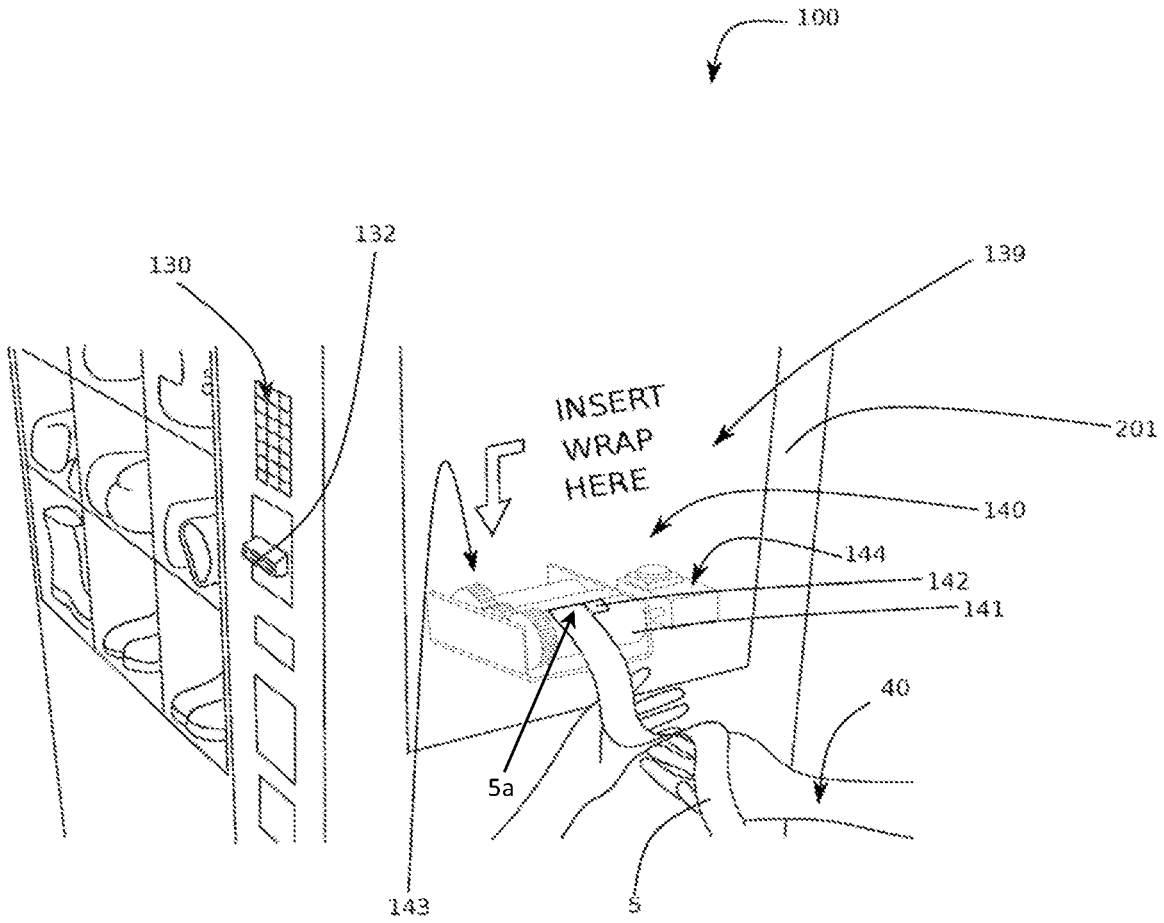
FIG. 2 is a side-front perspective view of the apparatus of FIG. 1, according to an embodiment of the present disclosure.

FIG. 2 shows a side-front perspective view of the apparatus 100 of FIG. 1, according to an embodiment of the present disclosure. As shown, the apparatus 100 may be used for winding and dispensing a non-adhesive wrap 5; the non-adhesive wrap 5 including a first end and a second end. Further, the non-adhesive wrap 5 may include an unwound state and a wound state, and a wrap length defined by a distance between the first end and the second end when extended out in the unwound state. In a preferred embodiment, the non-adhesive wrap 5 may be a fighting hand wrap.

Further, as shown in this figure, the wrap-roller 140 may be disposed within the housing 110. The wrap-roller 140 may also be electrically coupled to the power supply and configured to receive the non-adhesive wrap 5 in the unwound state by the first end 5*a* from the user interface, and further configured to wind the non-adhesive wrap 5 about the first end until the non-adhesive wrap 5 is placed in the wound state.

The user-interface 130 may be fixed to the housing 110, electrically coupled to the power supply, and configured to receive the non-adhesive wrap 5 in the unwound state as manually fed in by the first end by a user. Further, the user-interface 130 may be configured to selectably operate at least one of the wrap-roller 140 and the dispenser 150. As shown, the user-interface 130 may include a payment-interface 132. This payment-interface 132 may be configured to condition at least one of receiving the non-adhesive wrap 5 in the unwound state and dispensing the non-adhesive wrap 5 in the wound state upon the user making a predefined payment via the payment-interface 132 (enabling monetization). In some embodiments, a disposable spool 141 is supplied. The spool 141 has a fastener 142 such as Velcro or an adhesive strip, etc. for engagement with the non-adhesive wrap 5. A wrap machine 139 comprises a winding mechanism 143 and a wrap roller 140. The wrap-roller 140 is configured to stop the winding mechanism 143 when the user 40 pulls on the wrap 5 during winding. To facilitate this winding behavior, tension sensor 144 inside of the wrap-roller 140 sends a signal to wrap-roller 140 when the tension in the wrap 5 is high enough to indicate tangling of the wrap 5.

When the user 40 presses a button on the user-interface 130 to wrap the hand wraps 5 and after paying, a disposable spool 141 with a fastener 142, for instance Velcro, in the middle of it will be dispensed from the apparatus 100. Then the customer will move to the side 201 of the vending machine 200 and place the spool 141 in between the first end and the second end of the wrap machine 139 until it clicks. After it clicks, the customer will connect the harsh part of the Velcro from the wrap 5 to the spool 141 which has the soft part of the Velcro attached to it. Then, the customer will press the start button (not shown) to start the winding mechanism 143. To prevent the wrap 5 from getting tangled while the winding mechanism 143 is operating, a sensor 144 inside the wrap machine 139 is included. If the wrap 5 remains without too much tension, then the winding mechanism 143 continues to wind. However, if the customer pulls the wrap 5, the sensor signals the winding mechanism 143 to stop until the customer untangles the wrap 5. When the wrap 5 is completely wrapped, the user 40 removes the spool 141. Then, the user 40 can place his/her wrap 5 inside the gym bag so that it's ready for the next workout.

Figure 3:
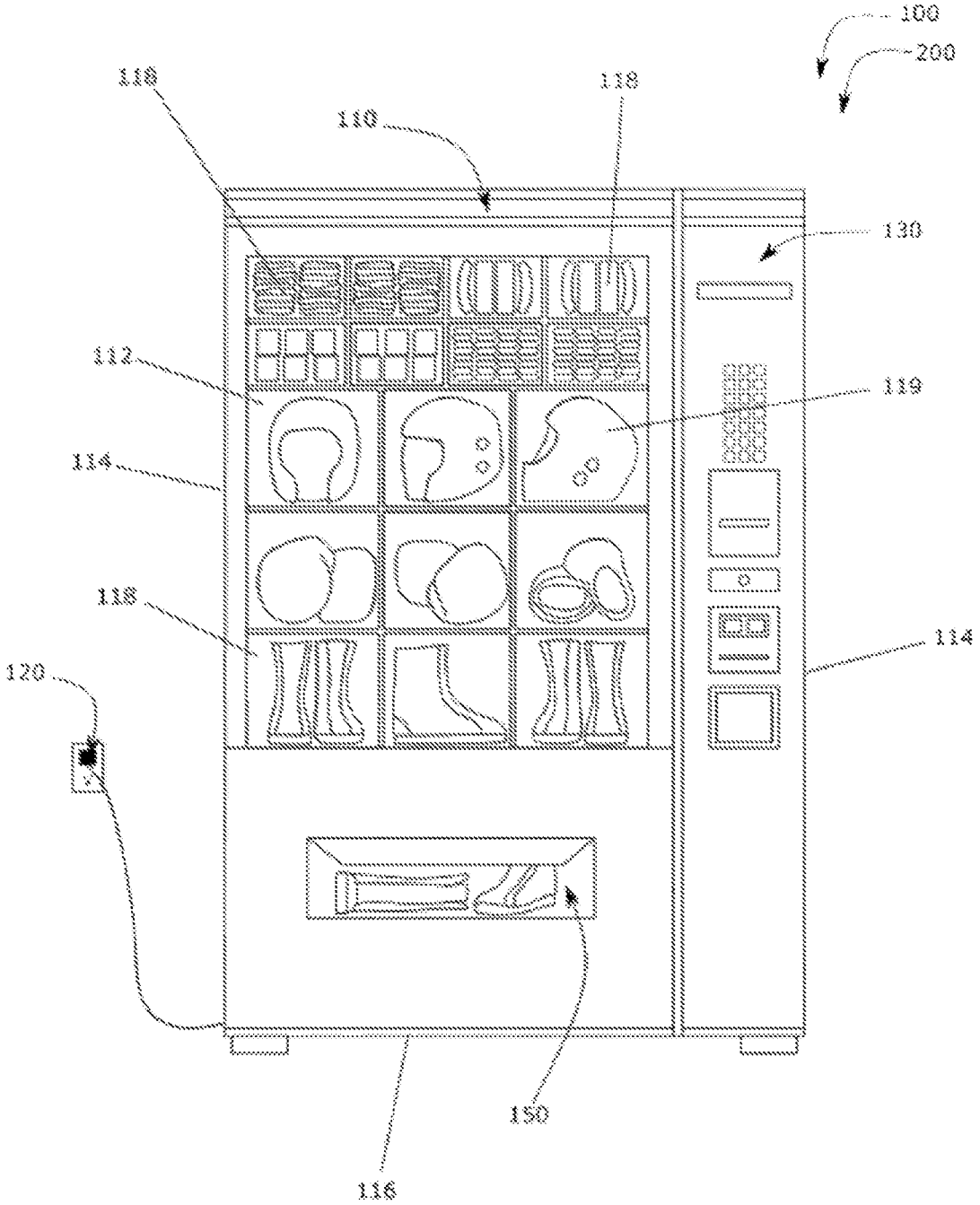
FIG. 3 is a front perspective view of the apparatus of FIG. 1, according to an embodiment of the present disclosure.

Referring now to FIG. 3 showing a front perspective view of the apparatus 100 of FIG. 1, according to an embodiment of the present disclosure. In a preferred embodiment, the apparatus 100 may be a part of a vending machine 200. As above, the vending machine 200 may include the housing 110, the power supply 120, the user-interface 130, the wrap-roller 140 (FIG. 2) and the dispenser 150. In this embodiment, however, the housing 110 may include an inner-chamber 112 defined by at least four walls 114 and a base 116. As illustrated, the inner-chamber 112 may include a plurality of compartments 118 each configured to store at least one item 119 therein.

The user-interface 130 may be configured to allow for selection of at least one item 119 by a user. In the preferred embodiment, the at least one item 119 can be more than one item. Examples of the plurality of items may include pre-wound fighting hand-wraps, shoes, boxing gloves, a mouth guard, a souvenir, and the like. However, it should be appreciated that the vending machine 200 may store and dispense a variety of different items and is not limited to the items listed here for monetization purposes.

Figure 4:
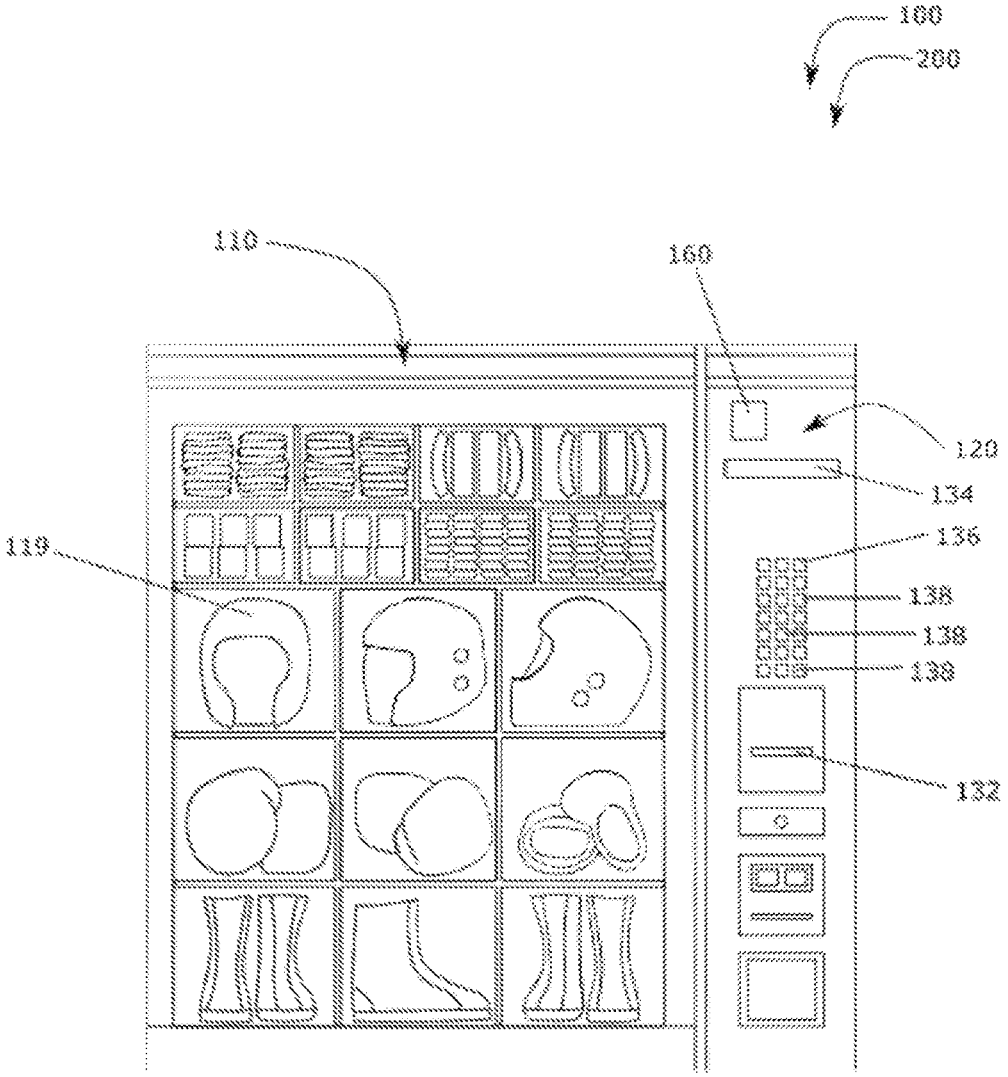
FIG. 4 is a front perspective view of the apparatus of FIG. 1, according to an embodiment of the present disclosure.

FIG. 4 shows a front perspective view of the apparatus 100 of FIG. 1, according to an embodiment of the present disclosure. Shown here is the user-interface 130 and a plurality of items. As above, the user-interface 130 may include the payment-interface 132. Further, the user-interface 130 may include a display screen 134 and a keypad 136 for selection of at least one item 119. In this embodiment, the keypad 136 may include a plurality of buttons 138, and each of the plurality of buttons 138 may correspond to each of the plurality of items. The display screen 134 and the keypad 136 may be communicably coupled.

To aid in this, the vending machine 200 may further include a controller 160 disposed within the housing 110 and communicably coupled to the user-interface 130, the wrap-roller 140 and the dispenser 150. In this embodiment, the user may select at least one item 119 via the corresponding button on the keypad 136, the controller 160 may send a signal to the display screen 134 and that item may then be displayed on the display screen 134 with a purchase price. The user may then make a payment via the payment-interface 132 and the controller 160 may then actuate the dispenser 150 (not shown in this figure) to dispense the item upon the payment. In the apparatus 100 embodiment above, the user may select the at least one item 119, or they may actuate the wrap-roller 140 (FIG. 2) via the user-interface 130 and feed the wrap into the user-interface 130.

In one embodiment, the display screen 134 may be a touchscreen, the keypad 136 may be displayed on the touchscreen configured for touch-selection by the user. In other embodiments, as shown in this figure, the keypad 136 may be a physical keypad 136 located on the housing 110 and display screen 134 may be a digital screen.

Figure 5:
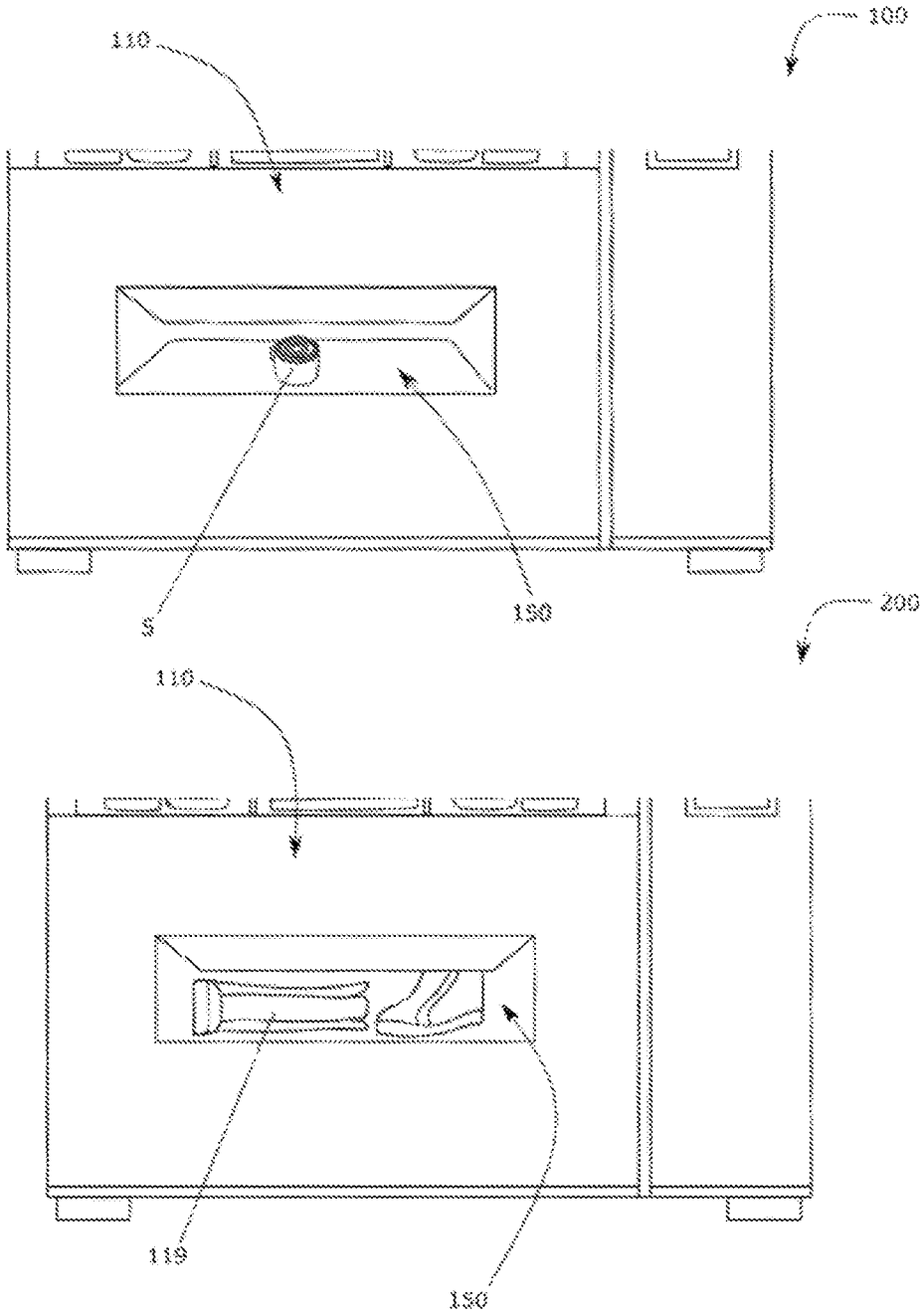
FIG. 5 is a front perspective view of the apparatus of FIG. 1, according to an embodiment of the present disclosure.

Referring now to FIG. 5 showing a front perspective view of the apparatus 100 of FIG. 1, according to an embodiment of the present disclosure. Shown in this figure is the dispenser 150. As shown, the dispenser 150 may be fixed to the housing 110. In the apparatus 100 embodiment as above, the dispenser 150 may be configured to dispense the non-adhesive wrap 5 in the wound state from the housing 110. In this embodiment, the controller 160 (FIG. 4) may receive a signal that the wrap-roller 140 (FIG. 2) has finished winding the hand-wrap 5 and may actuate the dispenser 150 to dispense the hand-wrap 5. In other embodiments, the wrap-roller 140 (FIG. 2) may automatically drop the hand-wrap 5 into the dispenser 150.

As shown in this figure, the dispenser 150 may be configured dispense at least one of the non-adhesive wrap 5 in the wound state and a selected at least one item 119 from the housing 110. In one embodiment, the dispenser 150 may include a conveyor-means configured to convey the at least one item 119 into the dispenser 150. In one example, the conveyor-means may be a mechanical arm actuated by the controller 160. In other embodiments, the conveyor-means may be a pusher located behind the at least one item 119 in the compartment and configured to push the at least one item 119 into the dispenser 150. Other embodiments may include a moving platform located in the compartment to allow gravity to drop the at least one item 119 into the dispenser 150. However, it should be appreciated that other conveyor-means may be used and are not limited to the examples listed here.

Figure 6:
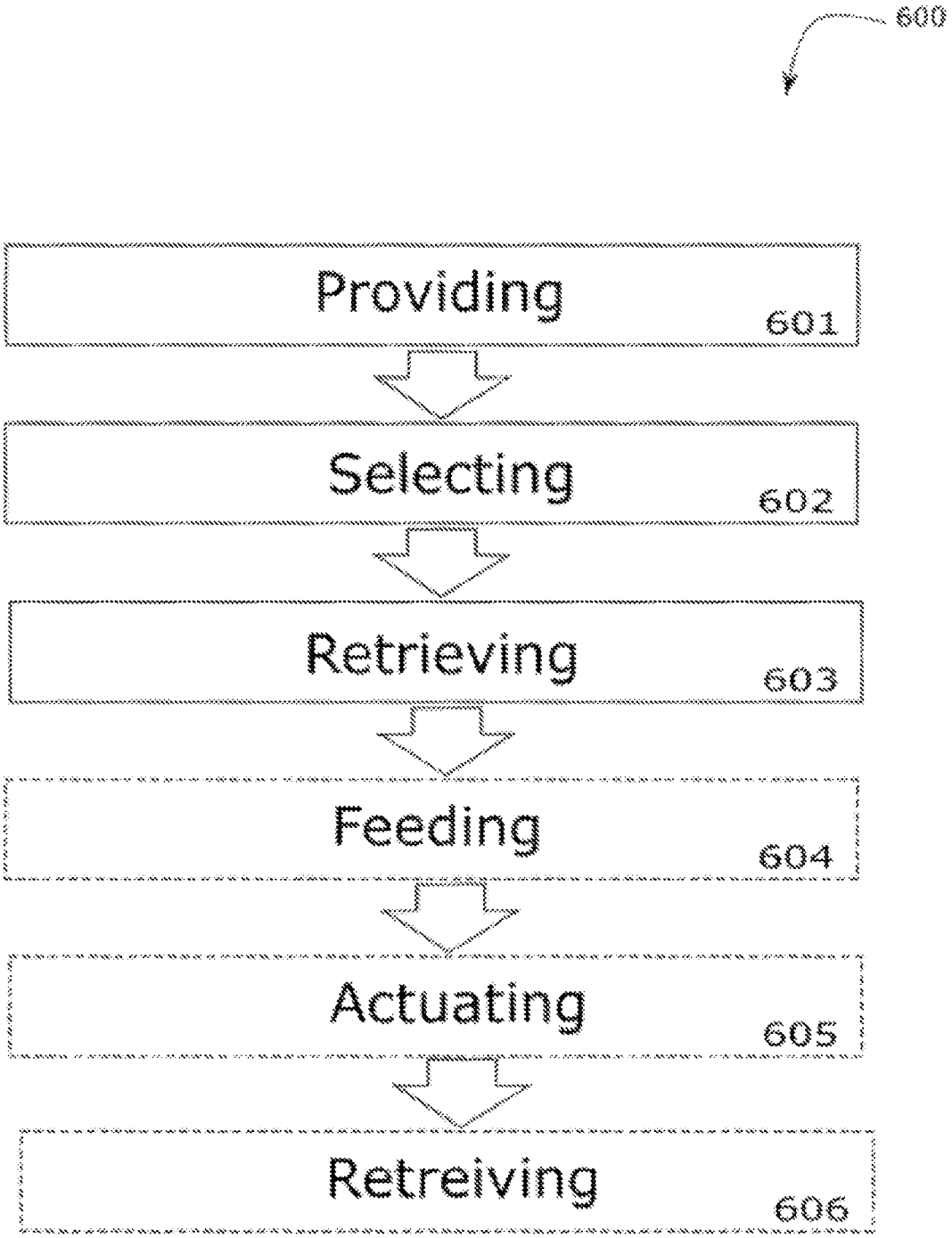
FIG. 6 is a flow diagram illustrating a method of use for the apparatus, according to an embodiment of the present disclosure.

FIG. 6 is a flow diagram illustrating a method of using a vending machine 600, according to an embodiment of the present disclosure. As illustrated, the method of using a vending machine 600 may include the steps of: step one 601, providing the vending machine 200 as above; step two 602, selecting at least one item 119 from the inner chamber via the user-interface 130; and step three 603, retrieving the selected at least one item 119 from the dispenser 150. Further steps may include, step four 604, feeding the first end 5*a* of the non-adhesive wrap 5 in the unwound state into the user-interface 130; step five 605, actuating the wrap-roller 140 via the user-interface 130; and step six 606, retrieving the non-adhesive wrap 5 in the wound state from the dispenser 150.

It should be noted that step four 604, step five 605, and step six 606 are optional steps and may not be implemented in all cases. Optional steps of method of use 600 are illustrated using dotted lines in FIG. 6 so as to distinguish them from the other steps of method of use 600.

The automatic warning device can take a variety of configurations. In some embodiments, the device can function to do any one or any combination of start and stop winding, sense tension on the wrap, us the tension signal to trigger a pause in winding, respond to signals from the vending machine to enable winding, to respond to manual input from the user to start or pause winding, to receive a spool from a user, to indicate when winding is complete, and to release a spool to the user.

It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for monetization and use of the apparatus 100 (e.g., different step orders within above-mentioned list, elimination or addition of certain steps, including or excluding certain maintenance steps, etc.), are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A vending machine comprising;
a dispenser;
a user interface with a payment interface mounted on an outer housing of the vending machine connected to the dispenser; and
a wrap machine disposed on the outer housing, connected to the user interface, and comprising:
a winding mechanism;
a wrap roller mechanically or electrically connected to the winding mechanism;
the wrap roller adapted to receive a first end of a wrap;
a power unit connected to the winding mechanism; and
a tension sensor mechanically or electrically connected to the winding mechanism; the tension sensor being adapted to send a signal to the wrap-roller when the tension in the wrap is high enough to indicate tangling of the wrap, and when the tension is high the wrap-roller is configured to stop the winding mechanism;
the wrap machine adapted to receive the wrap from a user.

2. The vending machine of claim 1 wherein the wrap machine is configured to wrap a hand wrap.

3. The vending machine of claim 1 wherein the wrap is a fighting hand-wrap.

4. The vending machine of claim 3 wherein the wrap is non-adhesive.

5. The vending machine of claim 3 wherein the user-interface is further configured to selectably operate at least one of the wrap machine and the dispenser.

6. The vending machine of claim 5 wherein the payment-interface accepts payment and the dispenser is adapted to dispense the spool.

7. The vending machine of claim 6 further comprising an inner-chamber having a plurality of compartments each configured to store an item.

8. The vending machine of claim 7 wherein the item is a spool.

9. The vending machine of claim 8 wherein the spool contains a pre-wound fighting hand-wrap.

10. The vending machine of claim 7 wherein the item is a pair of shoes.

11. The vending machine of claim 7 wherein the item is a pair of boxing gloves.

12. The vending machine of claim 7 wherein the item is a mouth guard.

13. A method comprising:

operating a user interface of a vending machine to pay for winding a wrap;

operating the user interface to engage a winding mechanism to wind a spool configured to receive the wrap;

guiding the wrap onto the spool and attaching a first end of the wrap to the spool;

actuating a wrap roller;

adjusting the wrap, wherein a tension sensor is adapted to connect to the winding mechanism, the tension sensor being adapted to send a signal to the wrap-roller when the tension in the wrap is high enough to indicate tangling of the wrap, and when the tension is high the wrap-roller is configured to stop the winding mechanism;

removing the spool after the wrap has wound onto the spool; and retrieving the wrap after it has been wound around the spool.

14. The method of claim 13 further comprising operating the user interface to pay for and receive the spool.

* * * * *